US010381770B1

(12) United States Patent
Crofoot et al.

(10) Patent No.: US 10,381,770 B1
(45) Date of Patent: Aug. 13, 2019

(54) PROTECTIVE GRID FOR LINEAR ELECTRICAL CONTACT ARRAY

(71) Applicant: Ohio Associated Enterprises, LLC, Painesville, OH (US)

(72) Inventors: Larry M. Crofoot, Perry, OH (US); Ronald D. Wright, Mentor, OH (US); John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/906,271

(22) Filed: Feb. 27, 2018

(51) Int. Cl.
*H01R 13/506* (2006.01)
*H01R 13/28* (2006.01)

(52) U.S. Cl.
CPC ..... *H01R 13/506* (2013.01); *H01R 13/28* (2013.01)

(58) Field of Classification Search
CPC ..... H01R 13/506; H01R 13/28; H01R 13/22
USPC ..... 439/289
See application file for complete search history.

(56) References Cited

U.S. PATENT DOCUMENTS 3,011,143 A 11/1961 Dean
3,634,811 A 1/1972 Teagno et al.
4,482,937 A 11/1984 Berg
4,688,866 A 8/1987 Legrady
4,732,565 A 3/1988 Ito et al.
4,734,060 A 3/1988 Kawawada et al.
4,737,118 A 4/1988 Lockard
4,820,182 A 4/1989 Harwath et al.
4,836,799 A 6/1989 Tomer
5,035,639 A * 7/1991 Kilpatrick ..... H01R 13/28 439/290
5,098,311 A 3/1992 Roath et al.
5,104,341 A 4/1992 Gilissen et al.
5,620,340 A 4/1997 Andrews
5,775,947 A 7/1998 Suzuki et al.
6,146,202 A 11/2000 Ramey et al.
6,193,537 B1 * 2/2001 Harper, Jr. ..... H01R 13/28 439/291
6,361,355 B1 * 3/2002 Matsuoka ..... H01R 9/2408 439/488
6,371,773 B1 4/2002 Crofoot et al.
6,551,119 B1 * 4/2003 Sakamoto ..... H01R 13/514 439/287
7,077,708 B1 * 7/2006 Johnson ..... H01R 13/115 439/687
8,998,645 B2 * 4/2015 Vanaleck ..... H01R 13/28 439/626
9,246,286 B2 * 1/2016 Stowers ..... H01R 13/514
9,472,881 B2 * 10/2016 Venaleck ..... H01R 13/28
(Continued)

*Primary Examiner* — Hae Moon Hyeon
*Assistant Examiner* — Peter G Leigh
(74) *Attorney, Agent, or Firm* — Renner, Otto, Boisselle & Sklar, LLP

(57) ABSTRACT

A molded grid pair is revealed that will protect vulnerable contact arrays from unwanted distortion while in manufacture or in service. These grids are specifically designed to accompany contact arrays, such as arrays of hermaphroditic contacts. The grid may cover the faces of the contacts that are opposite the faces that engage mating contacts, and may cover tips at the free ends of the contacts. The grid may be molded out of plastic, and may be mechanically coupled to a header body that secures and maintains spacing of the linear contacts, for example with the grid snapping onto a body.

11 Claims, 5 Drawing Sheets

(56) References Cited

U.S. PATENT DOCUMENTS

| | | | | |
|---|---|---|---|---|
| 2013/0102177 | A1* | 4/2013 | Venaleck | H01R 13/28<br>439/295 |
| 2015/0087175 | A1* | 3/2015 | Stowers | H01R 13/514<br>439/284 |
| 2017/0170594 | A1* | 6/2017 | Copper | H01R 13/04 |
| 2018/0183172 | A1* | 6/2018 | Copper | H01R 13/04 |

* cited by examiner

PROTECTIVE GRID FOR LINEAR ELECTRICAL CONTACT ARRAY

FIELD OF THE INVENTION

The invention is in the field of electrical connectors and electrical interconnect systems.

DESCRIPTION OF THE RELATED ART

Many various types of electrical connection systems have been used in the past. An example is the hermaphroditic interconnect system described in U.S. Pat. No. 5,098,311, in which electrical contacts from different connector parts engage one another to make electrical connection, with the engagement of ramps on opposite sides of the contacts being engaged for alternating contacts in a linear array, to balance the forces of engagement. While in service, the unprotected contacts can be deformed accidentally causing possible failure of the connector. Connections having multiple rows of contact arrays (such as having more than two rows) of contact arrays are particularly vulnerable, as they are exposed to any intrusion that can enter the width of the opening formed by the protective housing. It is desirable to provide greater protection for electrical contacts such as these.

SUMMARY OF THE INVENTION

A grid is used to protect parts of contacts of a header.

A grid may be made of hollow plastic, and is mechanically coupled to a header body, to protect parts of contacts that stick out from the header body.

Interlocking grids may be used to protect contact ends of mating headers.

An interlocking grid has ribs between every other contact, with the ribs extending in the same direction as a contact axis of the contacts.

According to an aspect of the invention, a grid for an electrical connector header includes: a hollow plastic element to be mechanically coupled to a plastic header body of the electrical connector header. The grid includes plural grid fingers. When the grid is installed on the plastic header body, each of the grid fingers protects tips and the non-engagement surfaces of a respective pair of adjacent contacts of a linear array of contacts, where the plastic header body maintains the contacts in the linear array.

According to another aspect of the invention, an electrical connector header includes: a linear array of electrical contacts with alternating orientation of engagement surfaces for mating with mating electrical contacts of a mating header, and non-engagement surfaces on opposite sides of the contacts, facing away from the engagement surfaces, the engagement surfaces alternating in facing between a first direction, and a second direction that is opposite to the first direction; a plastic body molded onto the contacts, and maintaining the contacts in the linear array; and a grid mechanically coupled to the plastic header body, wherein the grid includes plural grid fingers, each of the grid fingers protecting tips and the non-engagement surfaces of a respective pair of adjacent of the contacts According to an embodiment of any paragraph(s) of this summary, each of the grid fingers further includes a rib that passes between the contacts of the pair of contacts protected by the element According to an embodiment of any paragraph(s) of this summary, the ribs are parallel to axes along which the contacts extend from the body.

According to an embodiment of any paragraph(s) of this summary, the grid is made of plastic.

According to an embodiment of any paragraph(s) of this summary, the grid snaps onto the header body.

According to an embodiment of any paragraph(s) of this summary, each of the grid fingers includes: a pair of surface protectors for protecting the non-engagement surfaces of the pair of contacts; a pair of tip protectors for protecting the tips of the pair of contacts; and a rib running between the contacts of the pair of contacts.

According to an embodiment of any paragraph(s) of this summary, the rib is directly attached to the surface protectors and the tip protectors.

According to an embodiment of any paragraph(s) of this summary, for each of the grid fingers the surface protectors extend in opposite directions away from the rib.

According to an embodiment of any paragraph(s) of this summary, for each of the grid fingers the tip protectors extend in opposite directions away from the rib.

According to an embodiment of any paragraph(s) of this summary, the tip protectors have chamfers.

According to an embodiment of any paragraph(s) of this summary, the contacts are hermaphroditic contacts, configured to mate with contacts having the same shape.

According to an embodiment of any paragraph(s) of this summary, the header is in combination with other headers stacked together.

According to an embodiment of any paragraph(s) of this summary, the header is mated with an additional header having an additional grid.

According to an embodiment of any paragraph(s) of this summary, the grid and the additional grid interdigitate when mated together.

According to yet another aspect of the invention, an electrical connector header includes: a linear array of electrical contacts; a plastic body molded onto the contacts, and maintaining the contacts in the linear array; and a grid mechanically coupled to the plastic body, wherein the grid includes plural grid fingers, the grid fingers protecting tips and non-engagement surfaces of the contacts.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

An electrical connector header includes a grid that is placed over the linear array of contacts on the header, to protect the electrical contacts. The contacts may be hermaphroditic contacts that mate with similarly-shaped contacts, and the contacts may alternate in orientation along the line of contacts, to equalize forces when connectors are joined. The grid may cover the faces of the contacts that are opposite the faces that engage mating contacts, and may cover tips at the free ends of the contacts. The grid may be molded out of plastic, and may be mechanically coupled to a header body that secures and maintains spacing of the linear contacts, for example with the grid snapping onto the body. The grids of mating headers may interfit with each other to protect the contacts, while still allowing mating of the contacts. The headers with the grids may be stacked together in the same connector, with a larger opening in such a connector for the stacked contacts enhancing the need for protection of the contacts from damage prior to mating.

Figure 1:
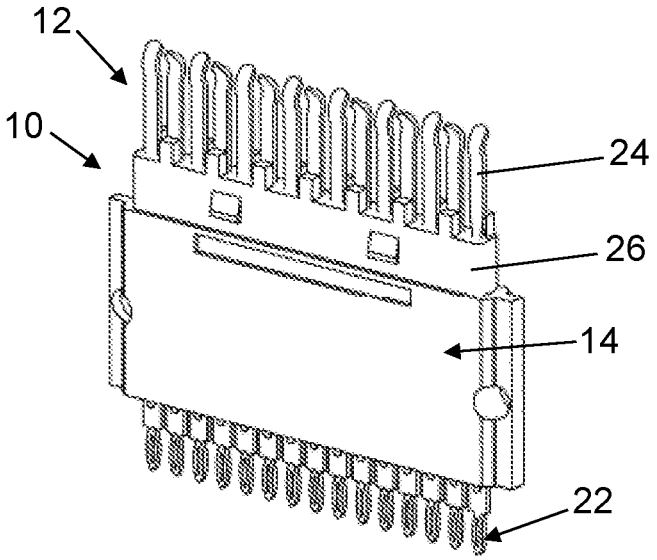
FIG. 1 is an oblique view of a header according to an embodiment of the invention.

FIG. 1 shows a header 10 that includes a linear array of contacts 12 held together by a header body 14 that is overmolded onto the contacts 12. The contacts 12 are evenly spaced along the header body 14. At one end the contacts 12 have tails 22 for connection to other electrically-conductive elements (not shown in FIG. 1), such as circuit boards, wires/cables, or other connector parts. The tails 22 may be split parts that resiliently deform, for example to enter and mechanically engage a hole, such as a via in a circuit board. At the opposite ends of the contacts 12 are mating ends 24 for mating and making electrical connection with contacts 12 of a mating header (not shown), such as part of a mating connector. The header body 14 has a narrowed region 26 for receiving a grid for protecting the mating ends 24, as described further below.

The contacts 12 may be hermaphroditic electrical contacts that are neither male nor female, and are configured to make connection with corresponding contacts having the same or similar shapes. The contacts 12 may be similar to those in co-owned U.S. Pat. No. 5,098,311, the text and drawings of which are incorporated herein by reference. The contacts 12 may alternate their facing, with even numbered contacts in the line of the contacts 12 facing in a first direction, and odd numbered contacts facing in the opposite direction. This has the advantage of balancing the forces on the connectors that are caused by the deflection of the contacts 12 as they come into contact with mating contacts. These forces are spread throughout the connectors, for example along the contacts 12 of an individual header 10, with the forces on adjacent (oppositely-facing) contacts cancelling one another out.

Figure 2:
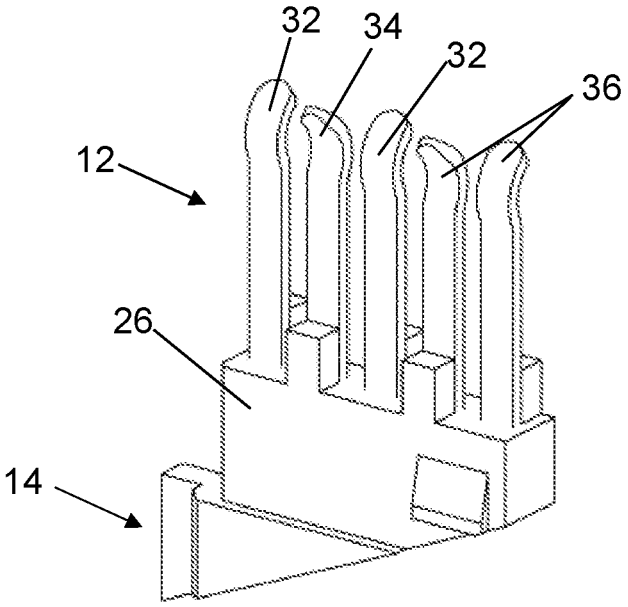
FIG. 2 is a close-up view of part of the header of FIG. 1.

FIG. 2 shows a close up view of some of the contacts 12. Each of the contacts 12 has an engagement surface or face 32 for engaging a corresponding contact of a mating header, a non-engagement surface or face 34 on the opposite side of the contact 12, and a tip 36 at the free end of the contact 12. The contacts 12 have various bends and curves to facilitate their mating with corresponding contacts, and with making a good electrical connection in the mating, with for example contact (and electrical connection) at multiple points at different longitudinal locations along the length of the contacts 12 (along an axis, a direction in which the contacts 12 extend). Further details regarding the shape of the contacts 12 may be found in U.S. Pat. No. 5,098,311.

The contacts 12 may alternatively have any of a variety of other configurations than the hermaphroditic contacts 12 shown in FIGS. 1 and 2. The contacts may have different configuration, with different modes of connection between contacts between different (mating) headers.

Figure 3:
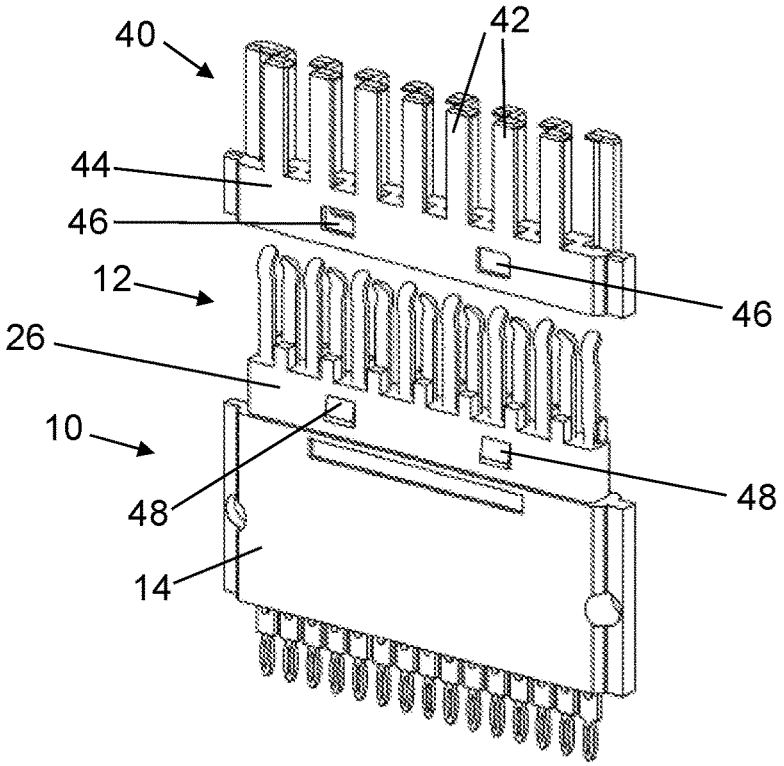
FIG. 3 is an exploded view of the header of FIG. 1, and a grid that mounts on a header body of the header.
Figure 4:
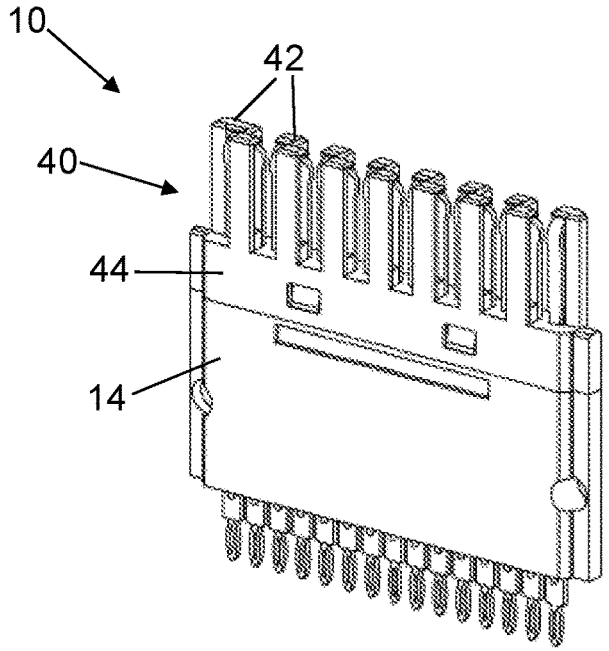
FIG. 4 is an oblique view showing the grid of FIG. 3 coupled to the header of FIG. 1.

FIGS. 3 and 4 show a grid 40 that is used to provide protection to the contacts 12. The grid 40 is a hollow plastic piece, for example being molded out of plastic, that is mechanically coupled to the header body 14. The grid 40 includes a number of grid elements 42, fingers that extend from a grid body 44 that has rectangular openings 46. The openings 46 receive protrusions 48 that are on the narrowed portion 26 of the header body 14. The protrusions 48 may be ramped wedges. This allows the grid 40 snap onto the header body 14, to mechanically couple the two together.

Figure 5:
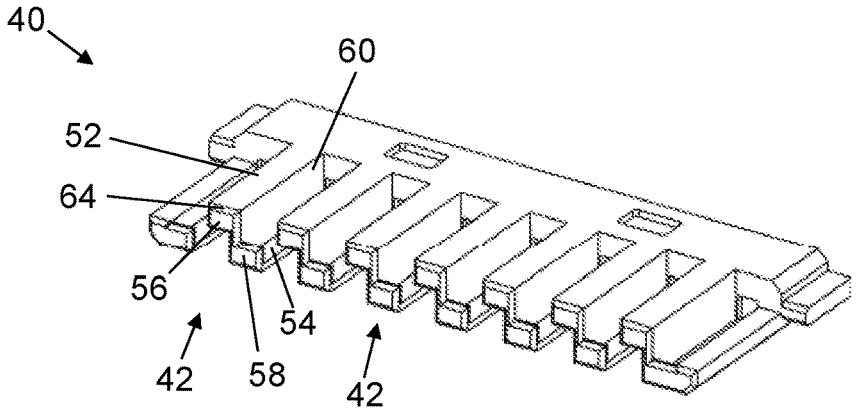
FIG. 5 is an oblique view showing details of the grid of FIG. 3.

Each of the grid fingers 42 includes features to shield and protect parts of two of the contacts 12. With reference in addition to FIG. 5 each of the grid fingers 42 includes a pair of surface protectors 52 and 54 for protecting the non-engagement surfaces of a pair of the contacts 12, a pair of tip protectors (or caps) 56 and 58 for protecting the tips of the pair of contacts 12, and a rib 60 running between the adjacent of the contacts 12. The rib 60 is directly attached to the surface protectors 52 and 54, and the tip protectors 56 and 58.

Since adjacent of the contacts 12 face in different directions the surface protectors 52 and 54 are on opposite sides (opposite faces) of the grid 40. The grid fingers 42 thus each have a Z shape, with the surface protectors 52 and 54 extending from opposite ends of the rib 60, and in opposite directions along the line of the contacts 12. The fingers each have a chamfer 64, such as on the caps 56 and 58, that guides insertion and nesting as the grid 40 engages a mating grid.

Figure 6:
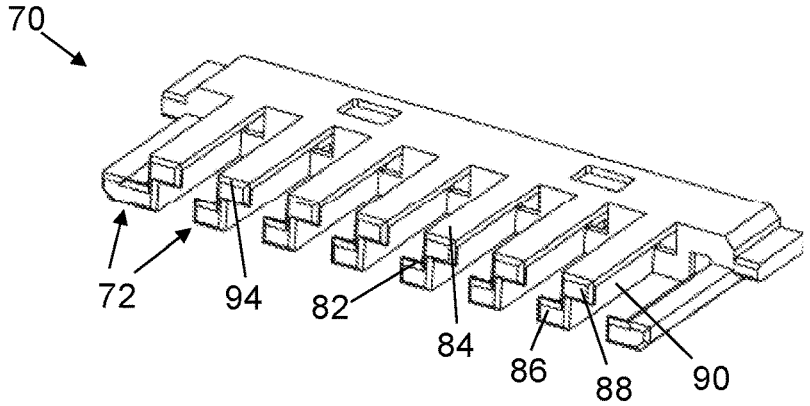
FIG. 6 is an oblique view of an additional grid, configured to mate with the grid shown in FIG. 5.

FIG. 6 shows a second mating grid 70, a grid that is configured to nest and mate with the grid 40 (FIG. 5) when a pair of headers such as the header 10 (FIG. 1) are mated. Whereas the grid 40 has a Z shape for its grid fingers 42 (FIG. 5), second mating grid fingers 72 of the second mating grid 70 have an S shape, although both the second mating grid fingers 42 and the grid fingers 72 protect the tips and non-engagement sides of contacts, and have ribs between adjacent of the contacts. The second mating grid fingers 72 each have a pair of surface protectors 82 and 84 for protecting the non-engagement surfaces of a pair of the contacts 12, a pair of tip protectors (or caps) 86 and 88 for protecting the tips of the pair of contacts 12, and a rib 90 running between the adjacent of the contacts 12. The rib 90 is directly attached to the surface protectors 82 and 84, and the tip protectors (or caps) 86 and 88. The surface protector 82 and the tip protector 86 extend from the rib 90 in the opposite direction from that of the extension of the surface protector 84 and the tip protector 88. The second mating grid fingers 72 each have a chamfer 94 for aiding engagement of the grids 40 and 70.

Figure 7:
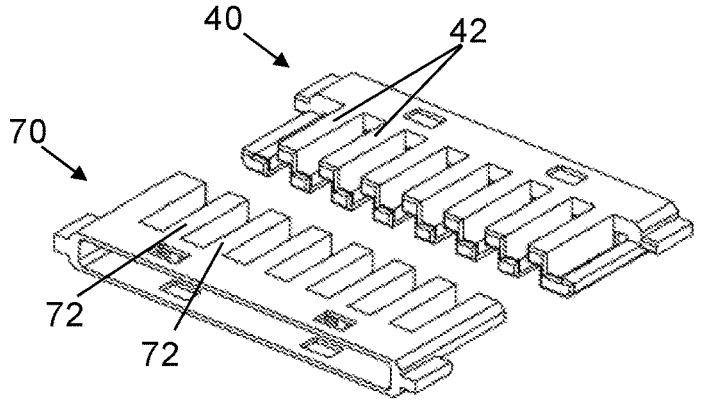
FIG. 7 is an oblique view that shows the grids of FIGS. 5 and 6, just prior to mating.
Figure 8:
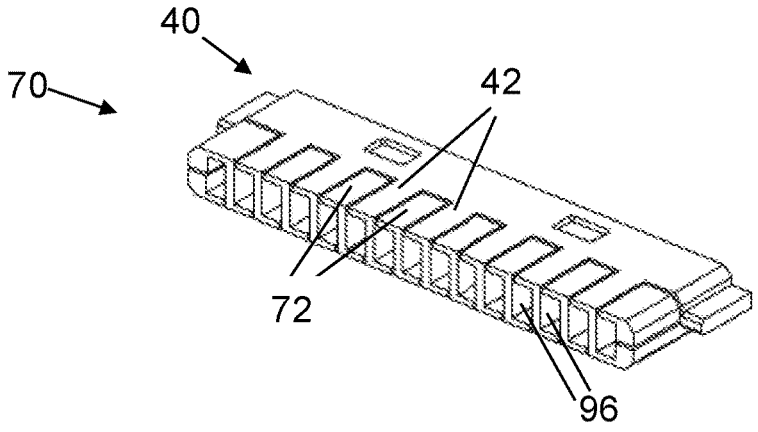
FIG. 8 is an oblique view that shows the grids of FIG. 7 mated together and sectioned through the center of engagement.

FIGS. 7 and 8 show the interaction between the grids 40 and 70 as they are coupled together, as parts of a pair of headers that are mated and nested together. The grids 40 and 70, when joined together with the grid fingers 42 and 72 interdigitated, fully enclose the contacts that would be mated within them. The ribs 60 and 90 of the two grids 40 and 70 provide isolation between the contacts. FIG. 8 shows how the grid fingers 42 and 72 provide and define a series of pockets or openings 96 that surround the connecting contacts on four sides.

Figure 9:
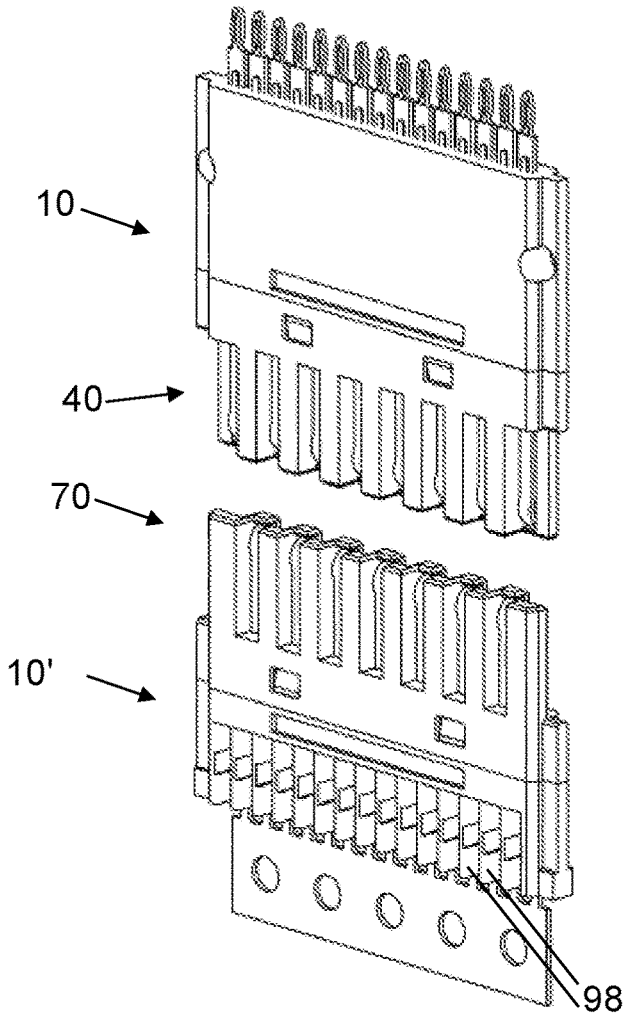
FIG. 9 is an oblique view showing a pair of headers with grids, just prior to mating.
Figure 10:
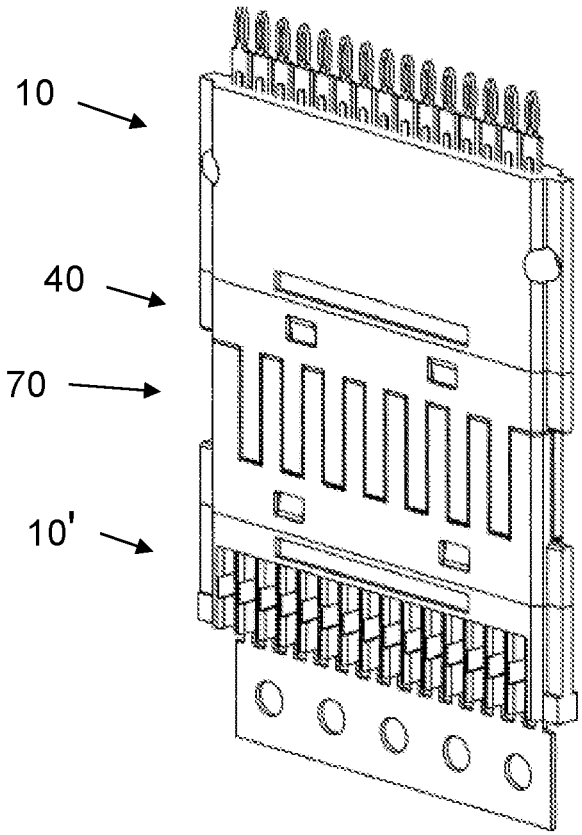
FIG. 10 is an oblique view that shows the headers of FIG. 9 mated together.

FIGS. 9 and 10 show the mating of a pair of headers 10 and 10' with the respective grids 40 and 70 mounted on their header bodies. The headers 10 and 10' may be parts of larger connectors, for example with multiple of the headers 10/10' stacked atop one another, and perhaps contained in a housing. The header 10' has slots 98 to allow electrical wire termination.

The mated pair of grids 40 and 70 consist of different plastic molded parts; the "S" grid 70 and the "Z" grid 40. These grids protect the contacts with ribs that extend parallel to the contact axis and have caps on the top of these ribs that shroud the tip of the contact to prevent any intrusion or "stub" from unwanted insertion. The cap also has a tapered edge that guides proper insertion of a mating contact. The body of the grid has windows that snap over the header body and retain the grid permanently in place. The grids are the same thickness as the headers that they protect, and therefore allow the headers to stack in a lateral array.

As described above, the grids 40 and 70 protect the contacts 12 (FIG. 1) during use of electrical connectors. In addition the grids 40 and 70 may advantageously protect the contacts from unwanted distortion during the manufacturing process and during service, and facilitate mating of electrical connectors. The contact arrays that are meant to engage will share an axis of engagement and face each other. The protection grids that will be attached to the contact arrays also face each other, and are configured to nest without causing interference with the contact function. When the grids are facing each other, they will nest and act as an insertion guide as well as a protector. The grids stay with the contact array from the molding through manufacturing and into service.

Many alternatives to the illustrated embodiments are possible. The contacts may have different configurations, for instance, and the grid may have a different configuration to correspond to the portions of the contacts to be protected.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector header comprising:

a linear array of electrical contacts;

a plastic body molded onto the contacts, and maintaining the contacts in the linear array; and a grid mechanically coupled to the plastic body, wherein the grid includes plural grid fingers, each of the grid fingers protecting tips and the non-engagement surfaces of a respective pair of adjacent of the contacts;

wherein the contacts have alternating orientation of engagement surfaces for mating with mating electrical contacts of a mating header, and non-engagement surfaces on opposite sides of the contacts, facing away from the engagement surfaces, the engagement surfaces alternating in facing between a first direction, and a second direction that is opposite to the first direction;

wherein the contacts are hermaphroditic contacts, configured to mate with contacts having the same shape;

wherein the grid also includes a grid body from which the grid fingers extend;

wherein the grid body has rectangular openings therein; and wherein the rectangular openings received protrusions of the plastic body, to mechanically couple the grid to the plastic body.

2. The header of claim 1, wherein the header is in combination with other headers stacked together.

3. The header of claim 2, wherein the header is mated with an additional header having an additional grid.

4. The header of claim 3, wherein the grid and the additional grid interdigitate when mated together.

5. The header of claim 1, wherein the protrusions are ramped wedges.

6. The header of claim 5, wherein the grid body leaves uncovered portions of the contacts, to allow electrical wire termination.

7. The header of claim 1, wherein each of the grid fingers includes:

a pair of surface protectors for protecting the non-engagement surfaces of the pair of contacts, when the grid is installed on the plastic header body;

a pair of tip protectors for protecting the tips of the pair of contacts; and a rib running between the contacts of the pair of contacts; and wherein the rib is directly attached to the surface protectors and the tip protectors.

8. The header of claim 7, wherein for each of the grid fingers the surface protectors extend in opposite directions away from the rib.

9. The header of claim 7, wherein for each of the grid fingers the tip protectors extend in opposite directions away from the rib.

10. The header of claim 7, wherein the tip protectors have chamfers.

11. The header of claim 1, wherein the grid is made of plastic.

* * * * *